US006280253B1

(12) United States Patent
Kraus et al.

(10) Patent No.: US 6,280,253 B1
(45) Date of Patent: Aug. 28, 2001

(54) METHOD AND APPARATUS FOR SELECTIVELY CONNECTING ELECTRICAL CIRCUITS AND COMPONENTS

(75) Inventors: Richard Allen Kraus, Farmington Hills; Thomas Dudley Belanger, Jr., Saline, both of MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/298,241

(22) Filed: Apr. 22, 1999

(51) Int. Cl.[7] ..... H01R 13/68

(52) U.S. Cl. ..... 439/621; 439/949; 439/594

(58) Field of Search ..... 439/643, 621, 439/649, 444, 949, 76.2, 115, 222, 291, 594; 361/399, 624

(56) References Cited

U.S. PATENT DOCUMENTS

| | | | | |
|---|---|---|---|---|
| 4,689,718 | * | 8/1987 | Maue et al. | 361/360 |
| 4,703,397 | | 10/1987 | Minoura et al. . | |
| 4,781,621 | | 11/1988 | Sugiyama et al. . | |
| 4,799,893 | | 1/1989 | Ogawa et al. . | |
| 4,850,884 | | 7/1989 | Sawai et al. . | |
| 4,906,195 | | 3/1990 | Kubota et al. . | |
| 4,909,745 | | 3/1990 | Hayashi . | |
| 4,915,637 | | 4/1990 | Ogawa et al. . | |
| 5,096,431 | | 3/1992 | Byrne . | |
| 5,154,647 | | 10/1992 | Ishitani et al. . | |
| 5,171,159 | | 12/1992 | Byrne . | |
| 5,288,141 | | 2/1994 | Isshiki et al. . | |
| 5,295,842 | | 3/1994 | Ozaki et al. . | |
| 5,300,917 | * | 4/1994 | Maue et al. | 338/49 |
| 5,478,244 | * | 12/1995 | Maue et al. | 439/76.2 |
| 5,540,602 | | 7/1996 | Bell . | |
| 5,606,483 | * | 2/1997 | Sawai et al. | 361/106 |
| 5,655,927 | | 8/1997 | Maue et al. . | |
| 5,662,491 | | 9/1997 | Antilla et al. . | |
| 5,703,757 | | 12/1997 | Hayes et al. . | |
| 5,709,567 | * | 1/1998 | Gladd et al. | 439/444 |
| 5,715,135 | * | 2/1998 | Brussalis | 361/622 |
| 5,722,851 | | 3/1998 | Onizuka et al. . | |
| 5,763,827 | * | 6/1998 | Sugiura | 174/49 |
| 5,949,148 | * | 9/1999 | Wagner | 307/10.1 |
| 6,008,982 | * | 12/1999 | Smith | 361/624 |
| 6,077,102 | * | 6/2000 | Borzi et al. | 439/364 |
| 6,116,916 | * | 9/2000 | Kasai | 439/76.2 |

FOREIGN PATENT DOCUMENTS

| | | |
|---|---|---|
| 940914A | 11/1963 | (GB) . |
| 1585463A | 3/1981 | (GB) . |
| WO93/26141 A1 | 12/1993 | (WO) . |

OTHER PUBLICATIONS

Grote and Hartmann Verbindungstechnik, Produktspiegel, pp. 18–20, 61, 104, and 129, Germany. No Date.

* cited by examiner

*Primary Examiner*—Tulsidas Patel
(74) *Attorney, Agent, or Firm*—Brinks Hofer Gilson & Lione

(57) ABSTRACT

An electrical connection and power distribution assembly 10 including a dynamically configurable array of substantially identical terminal members 12, 14 which are disposed upon a dielectric surface 66, which may be selectively connected to a plurality of automobile circuit assemblies 99, 101, and 110; which may selectively receive fuses 93 or other components; and which may be selectively interconnected and/or selectively severed to form a desired and/or required circuit and component interconnection scheme.

7 Claims, 7 Drawing Sheets

METHOD AND APPARATUS FOR SELECTIVELY CONNECTING ELECTRICAL CIRCUITS AND COMPONENTS

FIELD OF THE INVENTION

This invention relates to a method and to an apparatus for selectively connecting electrical circuits and components, and more particularly to a method and to an apparatus for fuseably protecting and for selectively distributing electrical power to these circuits and components.

BACKGROUND OF THE INVENTION

Electrical circuit connection and power distribution assemblies, commonly referred to as "junction boxes," are used within automobiles to provide a convenient physical and electrical interface for the selective connection between the various automobile electrical circuits and between these circuits and various components, such as fuses and relays. Importantly, these automobile junction boxes also allow for the relatively efficient "troubleshooting" of these circuits by providing efficient access to the circuitry as well as providing an efficient and selective coupling and distribution of electrical power to these circuits and components. While prior junction boxes provided such a desired circuit, component, and electrical power distributive and connective interface, they suffered from several drawbacks.

Particularly, due to the complexity and the number of the various automobile circuits and components, prior junction boxes included and required the formation of a multi-dimensional, non-uniform, and relatively complicated stamped metal fret circuit pattern which required a relatively large amount of time to create, was "statically" designed to operate only with a unique circuit and component configuration, and was not capable of being easily and dynamically modified. Typically, a new junction box design was required for each new model of automobile that was produced and for each model that was electrically modified from one year to the next, thereby adding to the overall cost and complexity of modifying and creating new automobile designs.

There is therefore a need for a new and improved junction box which may be utilized by a wide variety of automobiles having different types, numbers, and arrangements of electrical circuits and components, thereby reducing the overall automobile production cost.

SUMMARY OF THE INVENTION

It is a first object of the invention to provide an assembly which overcomes some or all of the previously delineated drawbacks associated with prior electrical junction box assemblies.

It is a second object of the invention to provide an assembly which may be used within a wide variety of automobiles.

It is a third object of the invention to provide a relatively efficient and relatively cost effective method of manufacturing and/or creating electrical connection and power distribution assemblies, and certain terminal members contained within these assemblies.

According to a first aspect of the present invention, an electrical connection and power distribution assembly is provided. The assembly includes a dynamically configurable array of substantially identical terminal members which cooperatively allow for the selective connection by and between the various circuits and components of an automobile.

According to a second aspect of the present invention, an electrical connection and power distribution assembly is provided. The assembly includes a plurality of substantially identical terminal members, each of the terminal members having a distributed plurality of circuit connection portions. The terminal members are adapted to be arranged in an array of a selected size. Electrical connections are made by and between the various arrayed terminal members, and by and between the various automobile circuits and terminal members, thereby selectively providing a desired circuit connection and power distribution configuration.

According to a third aspect of the present invention, an electrical connection and power distribution assembly is provided. The assembly includes a plurality of substantially identical terminal members, each of the terminal members including a generally thin conductive body having a plurality of integrally formed and evenly spaced conductive blades projecting from the body in a first direction and a plurality of integrally formed and evenly spaced conductive receptacles which are linearly coextensive to the blades and which project from the body in a second direction; and a dielectric plate having a plurality of reception slot apertures, each of the reception slot apertures receiving a unique one of the plurality of blades.

According to a fourth aspect of the present invention, a method for distributing electrical power to a circuit is provided. The method includes the steps of providing a plurality of terminals each having a conductive lead frame and multiple termination portions integrally formed with the lead frame; coupling one of the multiple termination portions of a first of the plurality of terminals to the circuit; coupling one of the multiple termination portions of a second of the plurality of terminals to a source of electrical power; and selectively connecting the first and second of the plurality of terminals, thereby providing and distributing electrical power to the circuit.

These and other features, advantages, and objects of the invention will become apparent by reference to the following specification and by reference to the following drawings.

DETAILED DESCRIPTION OF THE PREFERRED EMBODIMENT OF THE INVENTION

Figure 5:
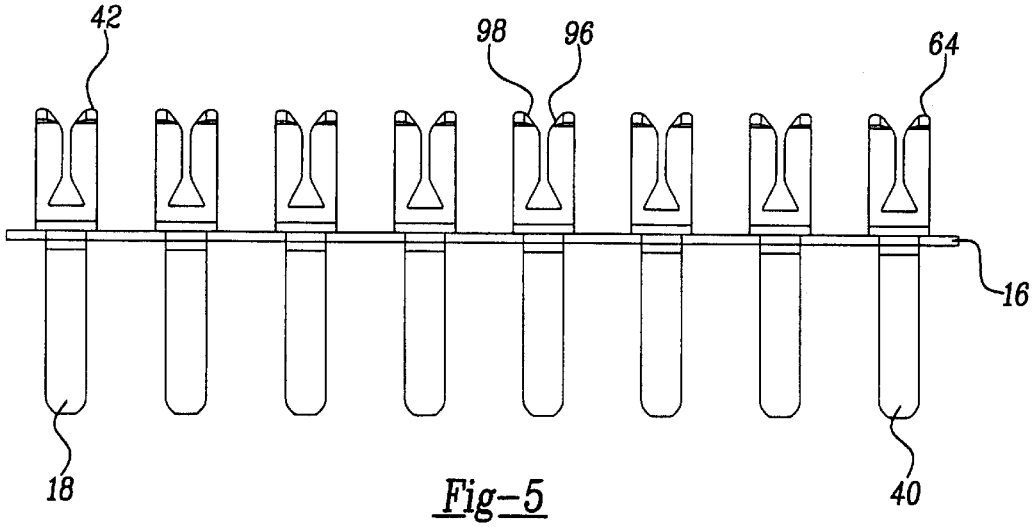
FIG. 5 is a side view of a terminal member made in accordance with an alternate embodiment of the invention.
Figure 6:
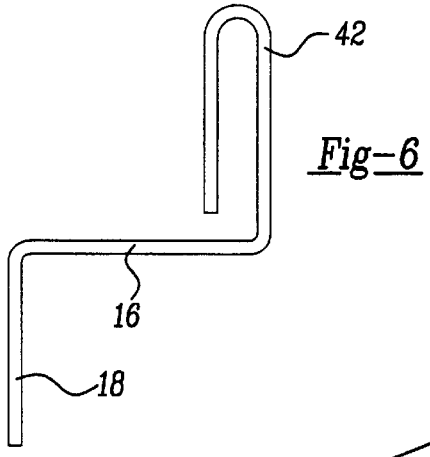
FIG. 6 is an end view of the terminal member shown in FIG. 5.
Figure 13:
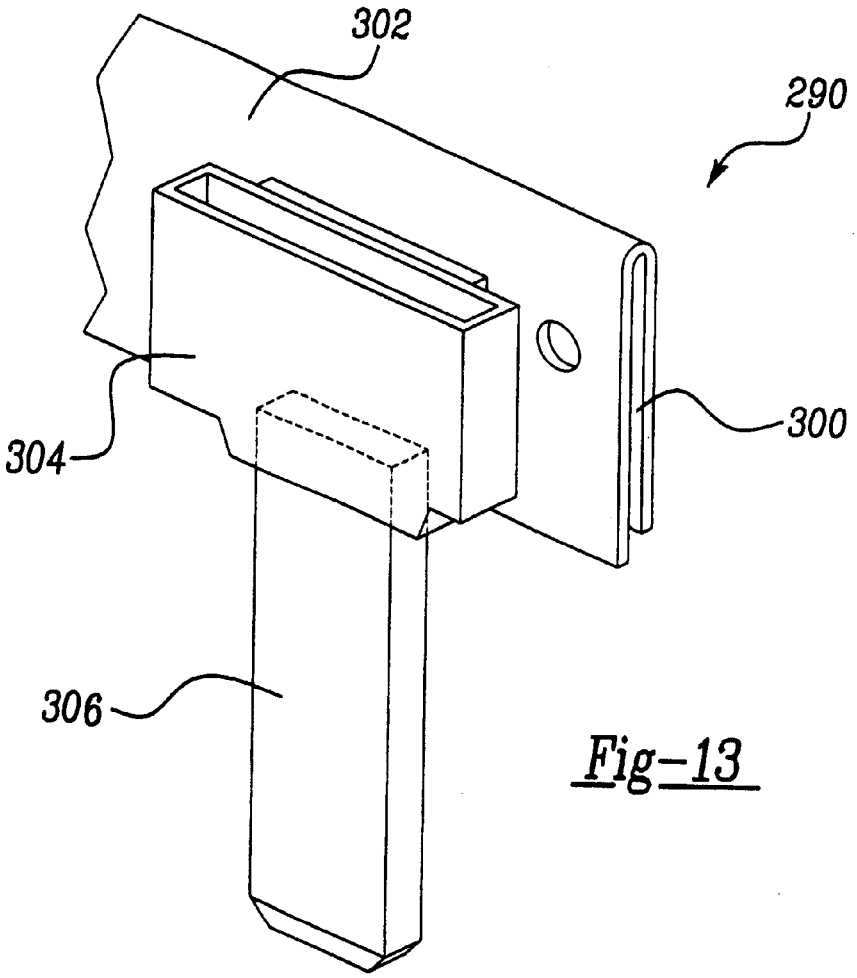
FIG. 13 is a perspective view of a terminal member made in accordance with the teachings of yet another alternate embodiment of the invention.

Referring now to FIGS. 1–4, there is shown an electrical connection and power distribution assembly 10 made in accordance with the teachings of the preferred embodiment of the invention. As shown, assembly 10 includes an array of substantially identical electrically conductive terminal members 12, 14, each having a relatively thin electrically conductive body or "lead frame" 16 including a plurality of integrally formed, evenly spaced, substantially identical, relatively thin, and electrically conductive blades 18–40, and electrically conductive receptacles 42–64. Blades 18–40 and receptacles 42–64 are integrally formed on opposed surfaces of the body 16, are mutually and linearly coextensive with the body 16, and respectively project from body 16 in opposite directions. Particularly, each receptacle 42–64 is paired with a unique one of the blades 18–40 and surfaces 41 and 43 are co-planar with body 16. In an alternate terminal embodiment, shown best in FIGS. 5 and 6, blades 18–40 and receptacles 42–64 orthogonally project in opposed directions from body 16. Alternatively, body 16 is substantially eliminated from the terminals shown in FIGS. 5 and 6 and portions 42 and 18 are directly connected. Further, as shown best in FIG. 13, terminal 290 may be formed by a folding a metal member 300 and by placing a series of each of the substantially rectangular conductive receptacles 304 on one of the side surfaces 302 of the member 300 and forming a series of conductive blades 306 which connect to a unique one of the receptacles 304 disposed upon surface 302. The folding of member 300, in the foregoing manner, increases the electrical conductivity of the terminal 290 over that provided by thinner terminal designs, such as those shown in FIG. 1.

Assembly 10 further includes at least one dielectric board or surface 66 having a plurality of substantially identical slotted apertures 68 which are adapted to frictionally receive a unique one of the blades 18–40 and to allow the received blades 18–40 to pass through the board 66. Particularly, the width of each of the slots 68 is slightly smaller than the width of flange 70 which is integrally formed upon each blade 18–40. Each flange 70 is adapted to pass through board 66 and to substantially prevent the undesired detachment of the blades 18–40 from the board 66. Circuit assemblies or automobile "harnesses" 99, 101, each having a plurality of conductive busses or circuits 103, which traverse through an automobile and connect to the various electrical components of an automobile, each have a portion which is selectively stacked beneath board 66. Each stacked circuit assembly portion 99, 101 is separated by a dielectric surface 105 which may be integrally formed upon one surface of assembly 99 which contacts assembly 101. Blades 18–40, after traversing through board 66, selectively, physically, and electrically connect to these busses 103 of circuit assemblies 99, 101 by soldering or other conventional electrical connection methodologies.

Assembly 10 also includes a generally hollow cover 72 having substantially identical flexible and resilient fasteners 74 which are integrally formed on opposed longitudinal ends of the cover 72, which each have a flexible and resilient hook portion 76, and which are each adapted to be frictionally inserted into a unique slotted aperture 78 resident within and through board 66. Particularly, each hook portion 76 is adapted to pass through board 66 and to engage the under surface 67 of board 66 in order to substantially prevent the undesired detachment of cover 72 from board 66. Further, each cover 72 includes a pair of substantially similar flexible and resilient members 80, 82 on a first side portion. Each member 80, 82 includes a flexible and resilient respective hook portion 84, 86 and each member 80, 82 is adapted to be frictionally inserted through a unique slotted aperture 88 in the board 66. Hook portions 84, 86 contact surface 67 and cooperate with portions 76 to substantially prevent the detachment of cover 72 from its placement upon board 66. Each cover 72 further includes a pair of substantially similar slots 90 on a second side surface 97. As shown best in FIG. 3, each portion 90 is adapted to selectively, frictionally, and removably receive a unique one of the members 80, 82, thereby physically coupling two adjacent covers 72. Further, each cover includes a plurality of top surface slotted apertures 92 which allow for communication into the hollow interior of cover 72.

Figure 1:
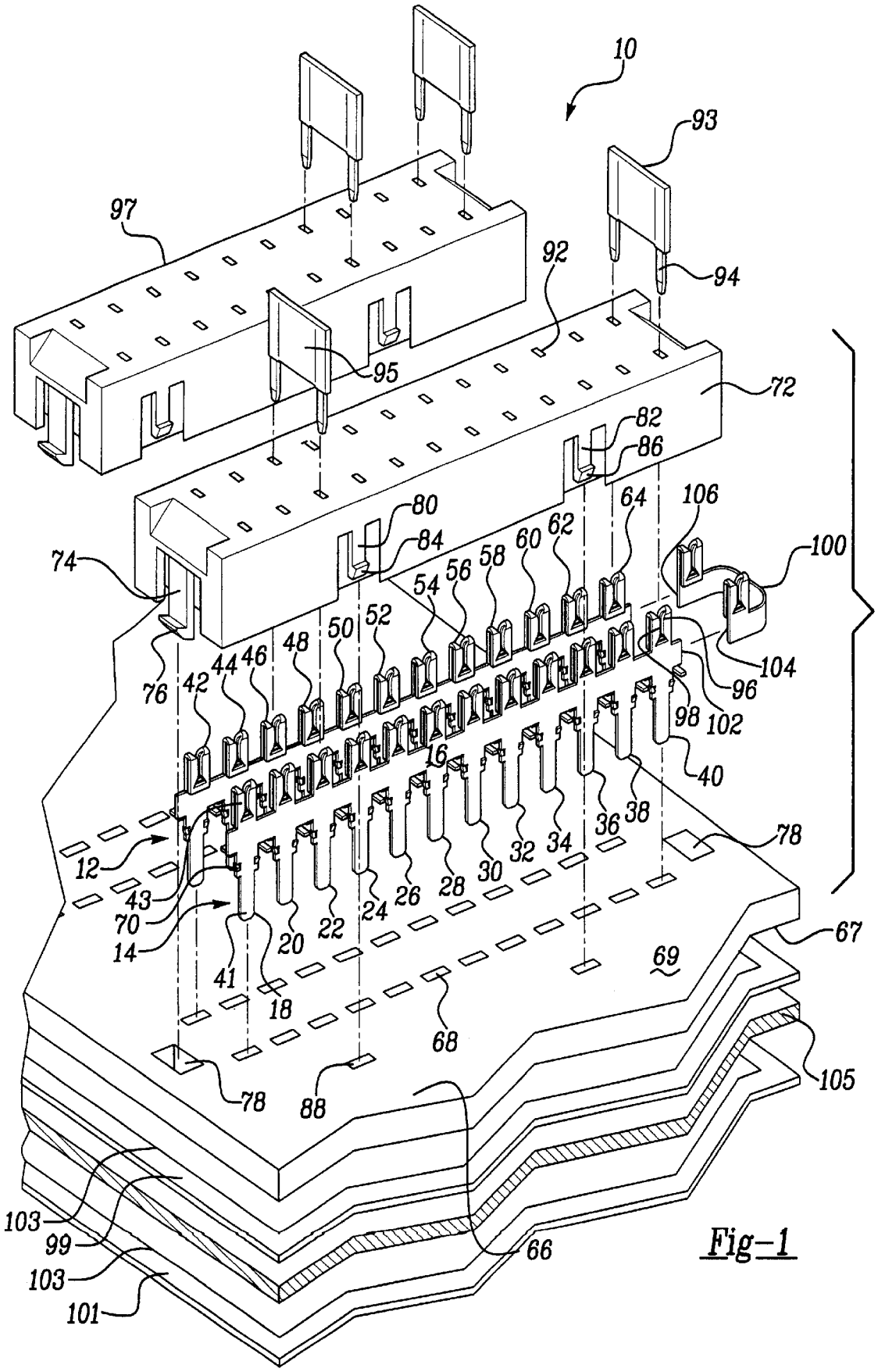
FIG. 1 is a perspective, fragmented, and unassembled view of an electrical connection and power distribution assembly made in accordance with the teachings of the preferred embodiment of the invention.
Figure 2:
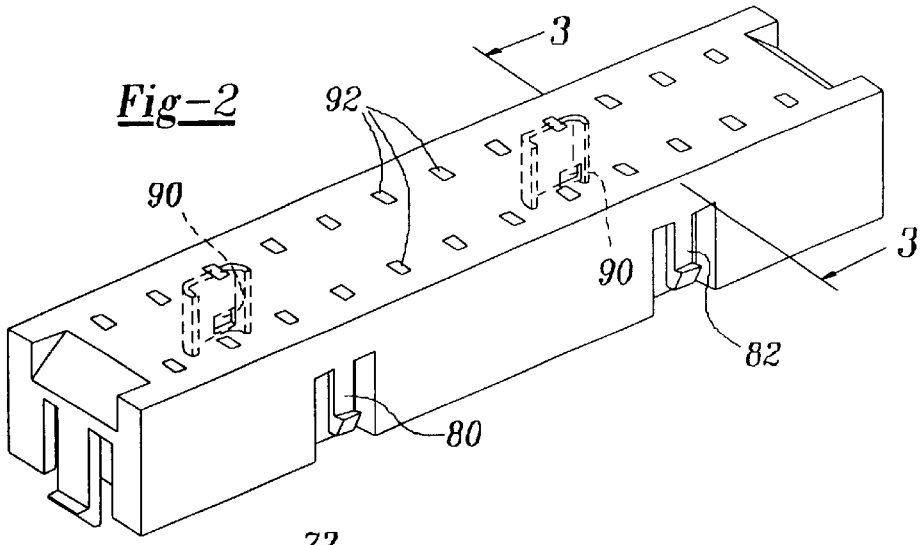
FIG. 2 is a perspective assembled view of a single portion of the assembly shown in FIG. 1.
Figure 3:
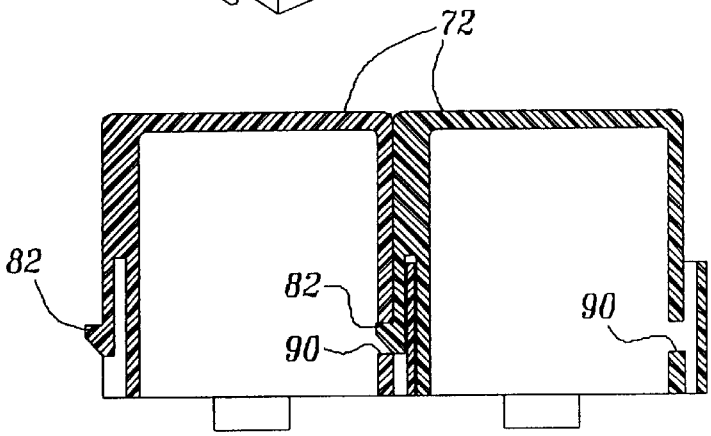
FIG. 3 is sectional view of the portion shown in FIG. 2 taken along view line 3—3.
Figure 4:
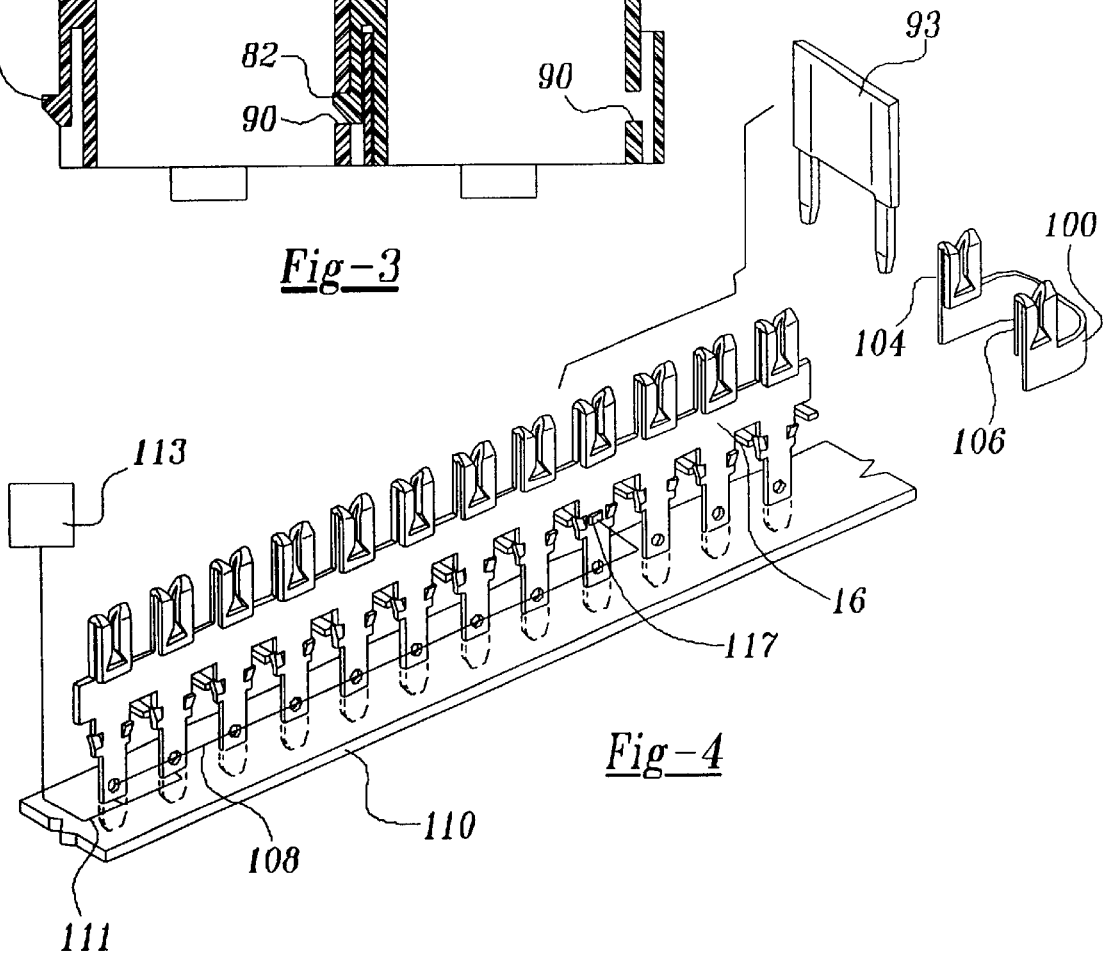
FIG. 4 is an unassembled perspective view of one of the terminal members shown in FIG. 1 illustrating the connection of the terminal member to a typical fuse, terminal member connector, and heat sink member.

As best shown in FIG. 1, each cover 72 is adapted to contain two linearly coextensive terminals 12, 14 which are secured to board 66 in the previously described manner. It should be realized that each cover 72 may be of a different shape and size from that shown in the Figures and that each cover 72 may be adapted to contain different numbers of members 12, 14 other than that shown in the Figures. One of the advantages of this invention is that assembly 10 may be created or configured to have a selectable number of members 12 and 14, thereby being adapted for use in a wide variety of automobiles having varying numbers, types, and arrangements of circuits and components. Each of these members 12, 14 is therefore a "building block" which may be selectively added to other substantially identical "building blocks" to form a junction assembly 10 of a desired size and configuration. Each slotted aperture 92 overlays a unique one of the receptacles 42-64 of each of the terminals 12, 14 and selectively and frictionally receives and allows one conductive terminal 94 of a protective fuse 93 or other type of electrical component, such as "dummy fuse" 95 or a relay to be selectively and removably inserted into a selected one of the receptacles 42–64 of a selected one of the terminal members 12, 14.

As shown, each receptacle 42–64 includes substantially identical, resilient, and opposed slotted ridges 96, 98 which cooperatively, resiliently, and removably fix and position the received terminal 94 into engagement with body 16 of a respective member 12, 14. In this manner, electrical power or an electrical signal which is applied to the terminal 12, 14 is applied and conducted to retained terminal 94. Each terminal member 12, 14 further includes substantially identical flange members 91, 107 integrally formed with body 16, orthoganally projecting in opposite directions away from body 16, and formed on opposite side surfaces of each of the blades 18–40. Flanges 91, 107 engage surface 69 of board 66 as the blades 18–40 pass through respective board apertures 68 and cooperatively position the longitudinal axis of symmetry of each blade 18–40 at a substantial right angle with respect to the planar board surface.

Figure 7:
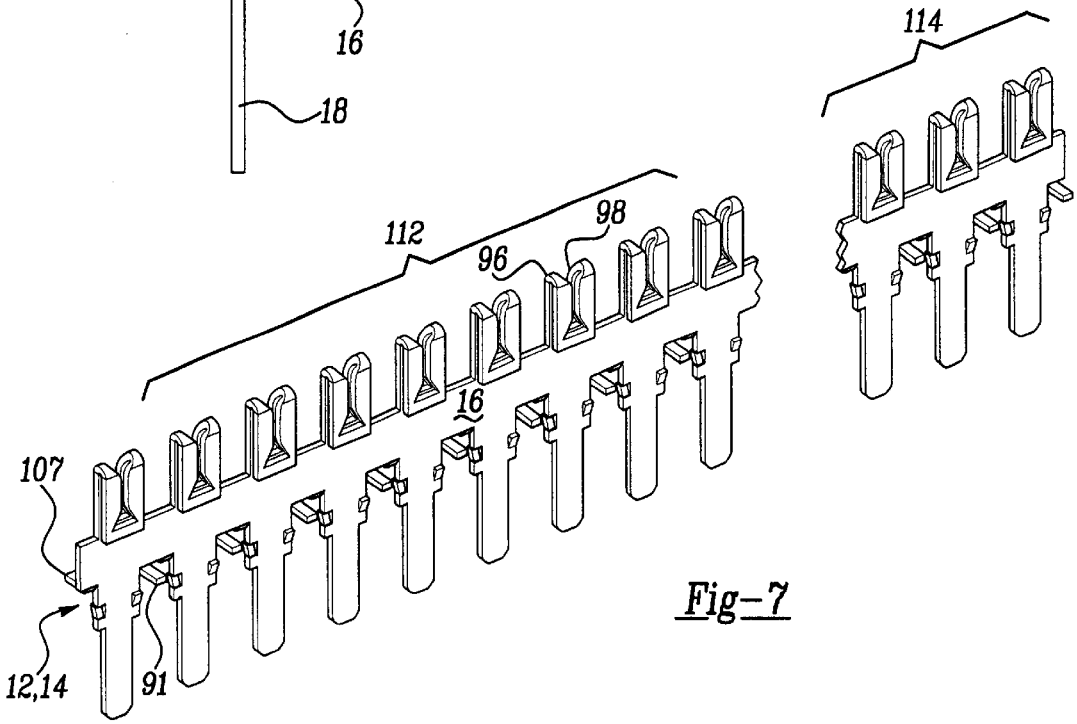
FIG. 7 is perspective view of one of the terminal members shown in FIG. 1 illustrating the creation of two electrical circuits from this terminal member.

Terminals 12, 14 may be selectively, physically, and electrically connected by the use of an electrically conductive connector 100 which is adapted to be soldered to each terminals 12, 14 or to frictionally receive one unique end portion 102 of each terminal in each integrally formed slot 104, 106. Terminals 12, 14 may also be physically and electrically connected by conductive circuit trace 108 appearing and/or integrally formed upon a circuit assembly 110 to which blades 18–40 may be selectively coupled. Trace 108 may be connected to a conventional "heat sink" allowing heat to be dispersed from the connected terminal assembly 12, 14. Alternatively, a conventional "heat sink" device 117 may be selectively attached to the blades 18–40 and coupled to a "heat sink" bus 108 in order to cool blades 18–40 and substantially prevent thermal malfunction. Circuit assembly 110 may also include an electrical power bus 111 which is electrically coupled to a source of electrical power 113 and which is selectively coupled to one or more of the blades 1840. The selective connection of the some or all of the blades 18–40 to the bus 111 allows electrical power to be "sourced", provided, and/or distributed to one or more of the terminal members 12, 14 and to the various components which are resident within the receptacles 42–64. Importantly, the use of multiple terminating blades 18–40 allows the assembly 10 to "spread out" the current thereby substantially ensuring that the net electrical power "drop", and concomitant resistive heat loss at each blade bus contacting interface remain relatively low. Hence, the blades 18–40 are not readily susceptible to heat or thermal fatigue or malfunction. As shown best in FIG. 7, the physical and electrical continuity of each terminal 12, 14 may also be selectively broken, cut, or severed in order to form two or more physically and electrically distinct circuits 112, 114.

Assembly 10 therefore may be "dynamically" configured to meet the electrical connection and power distribution needs of a wide variety of automobiles. First, a designer may dynamically adjust the size of assembly 10 by merely adding or removing "building block" terminals 12, 14. Secondly, the designer may dynamically configure and/or reconfigure the electrical circuit and component connections by selectively coupling certain blades 18–40 to certain circuit assemblies 99, 101, 110; by selectively disconnecting certain blades 18–40 from certain circuit assemblies 99, 101, 110; by selectively severing some portions of each or one of the terminals 12, 14; by selectively connecting some of the terminals 12, 14; and by selectively placing and/or removing certain components 93, 95 from certain of the receptacles 4264. Assembly 10 therefore represents a "toolkit" having an array of "parts" which allow for the selective and dynamic creation and dynamic modification of an electrical connection and power distribution assembly of a desired size and configuration, thereby obviating the need for a statically designed multi-dimensional fret pattern and reducing automobile production costs.

Figure 8A:
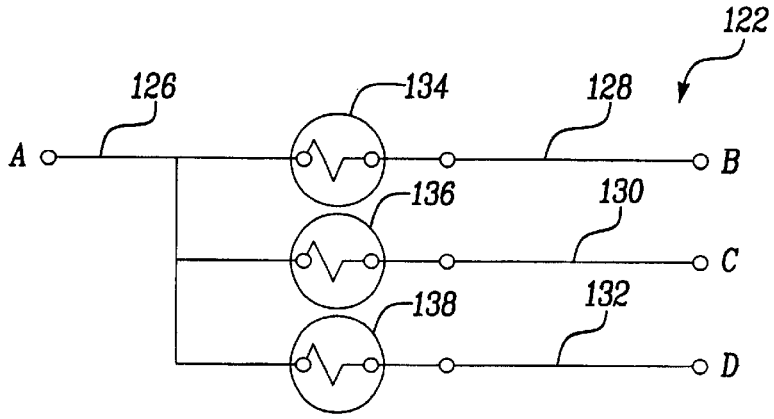
FIGS. 8(*a*) and 8(*b*) are two typical electrical circuits used within a typical junction box.
Figure 8B:
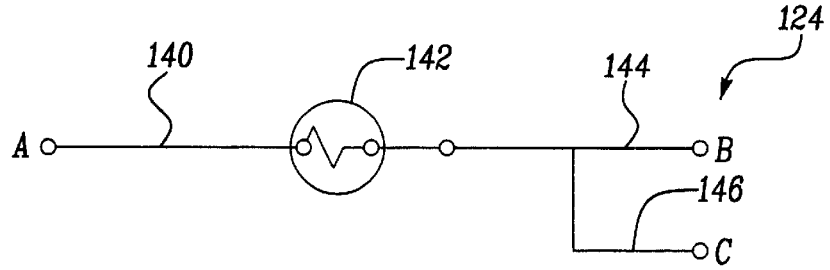

By way of example and without limitation, one common type of junctioned electrical circuit, required within an automobile, is schematically represented by circuits 122 and 124 of FIGS. 8(*a–b*). Particularly, circuit 122 requires the branching of a first conductive path 126 into several conductive circuit paths 128, 130, and 132. Each branched path 128–132 has a separate and respective fuse 134, 136, and 138. Circuit 124 requires the interruption of a first conductive path 140 with a fuse 142 and the creation of two separate conductive paths 144, 146. Paths 126, 128, 130, 132, 140, 144, 146 are selectively connected to other circuit assemblies (not shown).

Figure 9A:
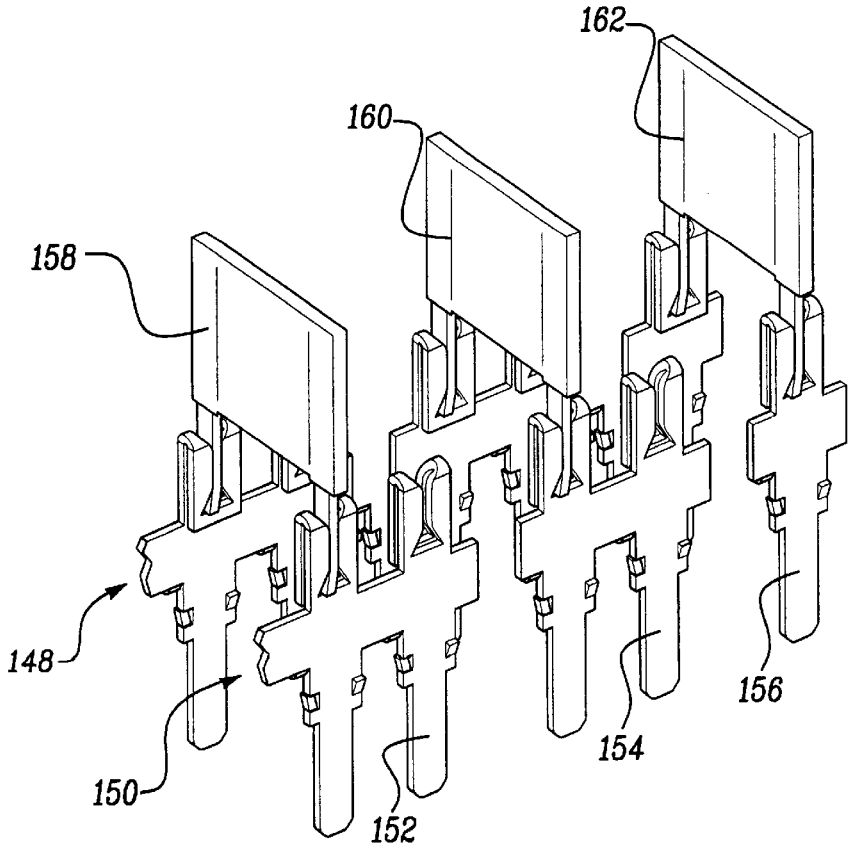
FIGS. 9(*a*) and 9(*b*) respectively and without limitation illustrate one electrical terminal member configuration which selectively produces the electrical circuits shown in FIGS. 8(*a*) and 8(*b*)
Figure 9B:
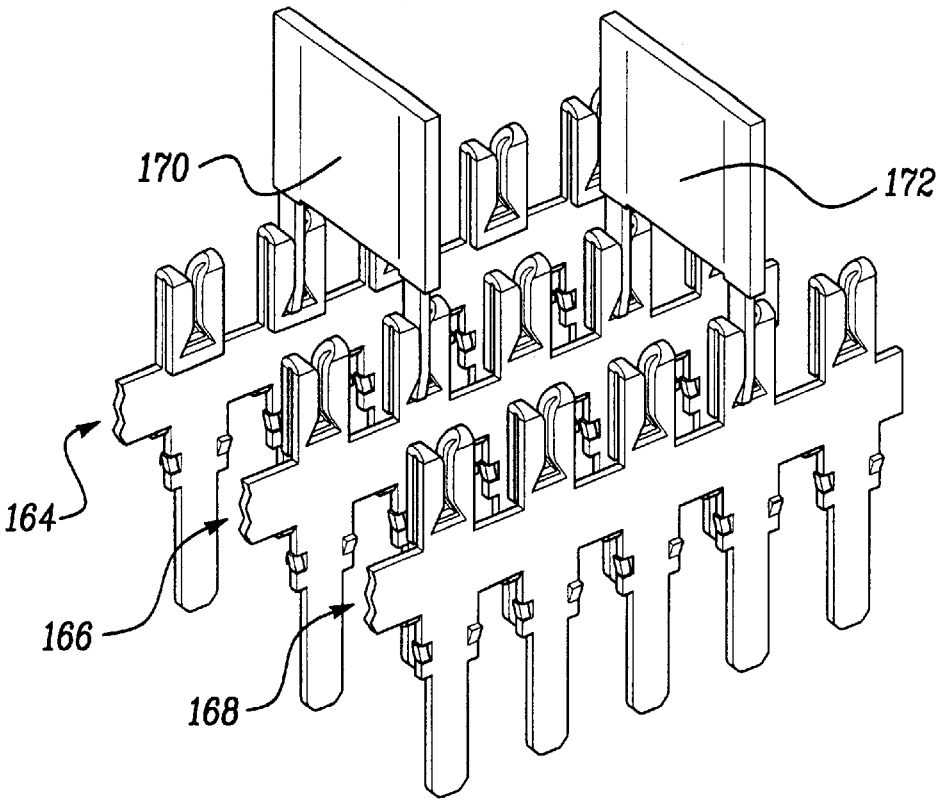

As shown in FIG. 9(*a*), circuit 122 may be implemented by use of two terminal members 148, 150 which may be respectively and substantially identical to terminal members 12 and 14 of FIG. 1. Particularly, member 150 is "cut" into three distinct terminal segments 152, 154, and 156 which respectively correspond to conductive paths 128, 130, and 132 of circuit 122. Terminal member 148 corresponds to conductive path 126. Fuses 158, 160, and 162 respectively correspond to fuses 134, 136, and 138, and respectively connect member 148 to the members 152, 154, and 156, thereby cooperatively forming circuit 122. Connecting blades of terminals 148, 152, 154, and 156 may be selectively connected to desired circuit assemblies and respectively represent termination points "A", "B", "C", and "D" of FIG. 8(*a*).

As shown in FIG. 9(*b*), circuit 124 is formed by the use of terminal members 164, 166, and 168, each of which may be respectively and substantially identical to terminal member 12. Particularly, member 164 respectively forms conductive path 140 while members 166 and 168 respectively form conductive paths 144 and 146. Fuse 170 is connected to members 164 and 166 and respectively corresponds to fuse 142. "Dummy" fuse 172 connects members 166 and 168. Connecting blades of terminals 164, 166, and 168 may be selectively connected to desired circuit assemblies and respectively represent termination points "A", "B", and "C" of FIG. 8(*b*).

Figure 10:
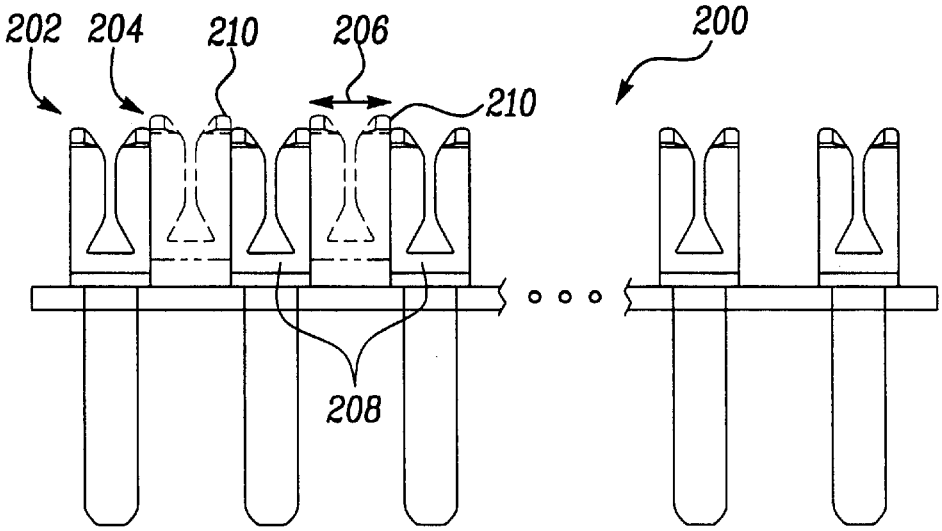
FIG. 10 is a top view of a nested terminal member configuration made in accordance with the teachings of an alternate embodiment of the invention.
Figure 14:
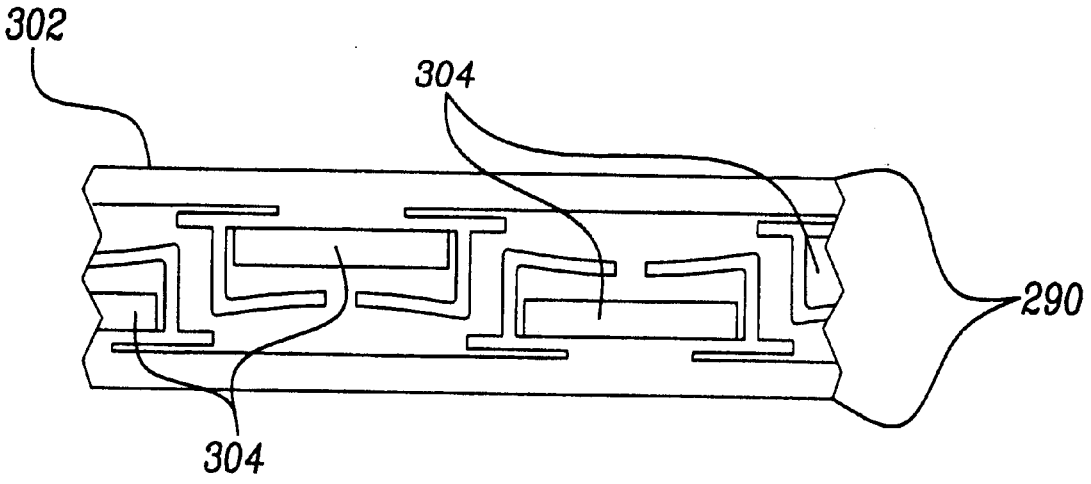
FIG. 14 is a top view of an alternate terminal nesting arrangement.

In an alternate terminal embodiment 200 shown in FIG. 10, terminals 202, 204, each of which may respectively correspond to and be substantially identical to terminals 12, 14, are "nested." That is, each space 206 between every adjacent receptacle pair 208 of member 202 is filled with a receptacle 210 of terminal 204. In this manner, space optimization is achieved and a considerable greater number of components may be placed within each cover 72. In another nesting embodiment 300, shown in FIG. 14, pairs of terminals 290 are aligned so that every receptacle 304 from a first of the terminal pairs is nested between adjacent receptacles 304 of a second of the terminal pair.

Figure 11:
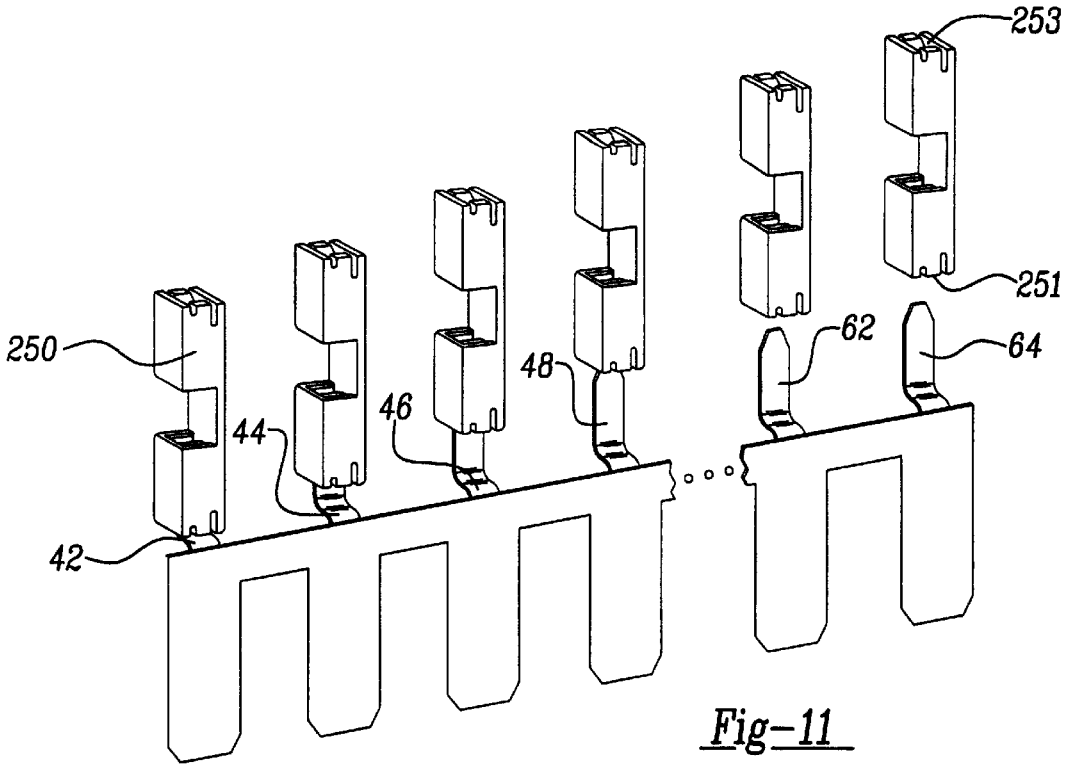
FIG. 11 is a perspective view of a terminal member made in accordance with the teachings of another alternate embodiment of the invention.

In yet another terminal embodiment shown in FIG. 11, terminal receptacles 42–64 comprise conductive "male" members. In this embodiment, assembly 10 includes a plurality of "female to female" connectors 250 having a first portion 251 attached to a unique member 42–64 and a second portion 253 attached to a unique receiving member 94.

It should be appreciated that terminal members 12, 14 may have a shape different from that shown in the various figures. For example, and without limitation, blades 18–40 could comprise a conventional "crimp type" connector or another conventional and commercially available connector and that the body 16 (or a portion of body 16) of these various terminal embodiments, may also be selectively and individually placed within a dielectric frame or substrate, thereby obviating the need for dielectric board 66. Additionally, it should be further appreciated that assembly 10 may be utilized in non-automotive applications requiring a selective connection of electrical circuits and components.

Figure 12:
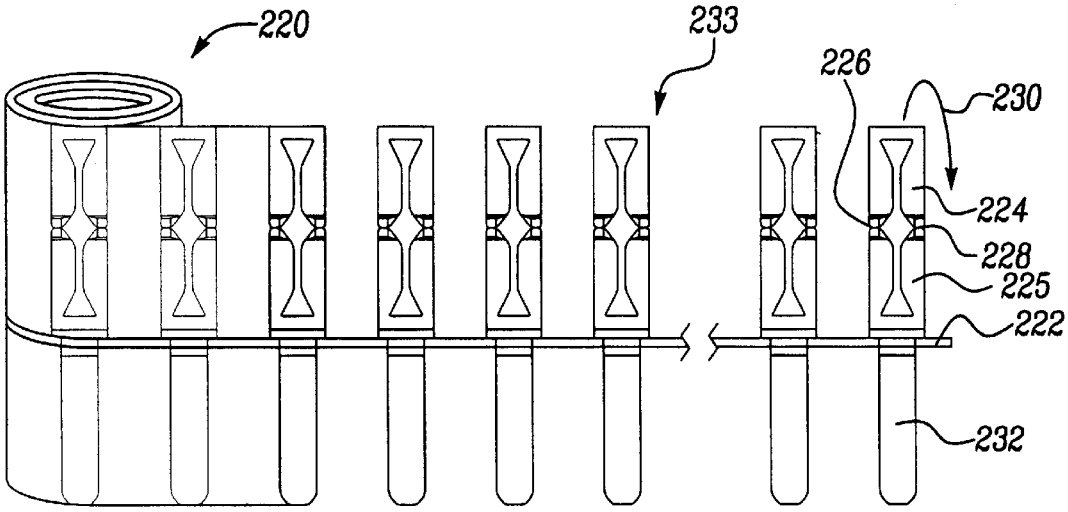
FIG. 12 is a perspective view of a terminal roll made in accordance with the teachings of the preferred embodiment of the invention.

Referring now to FIG. 12 there is shown a terminal roll 220 which is formed by a typical and conventional casting method. As shown, roll 220 includes a body or "lead frame" 222, corresponding to body 16; a plurality of blades 232, each corresponding to one of the blades 18–40; and a plurality of integrally formed receptacles 233. Particularly, each receptacle 233, within the roll 220, comprises substantially identical "v" shaped portions 224, 225 which are integrally connected at surfaces 226, 228. After a certain length is extended from the roll 220, the roll 220 is selectively severed, thereby forming one of the terminal members 12, 14. Each portion 224 is folded in the direction of arrow 230, thereby forming a series of receptacles 233, each receptacle having a shape which is substantially identical to one of the receptacles 42–64. The integral formation of the receptacles 233 with body 222 obviates the need for post formation welding or soldering of these receptacles reducing the overall cost of production and ensuring consistent quality of the produced terminal It is understood that the invention is not limited to the exact construction or method illustrated and described above, but that various changes and modifications may be made without departing from the spirit and scope of the invention as described in the following claims.

What is claimed is:

1. An assembly for selectively connecting electrical circuits in an automobile, comprising:

a dielectric surface defining a plurality of apertures;

a plurality of terminal members disposed on the dielectric surface selectively connected to said electrical circuits, each terminal member comprising a conductive body, a plurality of component receptacles integrally formed with the body and projecting from the body in a first direction, and a plurality of conductive blades integrally formed with the body and projecting from the body in a second direction opposite of the first direction, the blades individually passing through the apertures of the dielectric surface and adapted to be selectively connected to one or more of said circuits;

one or more housing members, each housing member adapted to substantially surround a specific number of terminal members and defining a plurality of opening in individual communication with the component receptacles, first resilient tab member adapted to engage the dielectric surface, and a second the resilient tab member adapted to engage a slot of another substantially identical housing member.

2. An assembly in accordance with claim 1, wherein the blades are linearly co-extensive with the plurality of component receptacles.

3. An assembly in accordance with claim 2, wherein the body is co-planar with the plurality of conductive blades and plurality of receptacles.

4. An assembly in accordance with claim 1, wherein each of the apertures has a width and each of the terminal members define a flange having a width slightly larger than the width of each aperture.

5. An assembly in accordance with claim 1, wherein further comprising a terminal connector providing electrical communication between at least two of the terminal members.

6. An assembly in accordance with claim 5, wherein at least one of the terminal members define projections and wherein the terminal connector defines at least two recesses adapted to individually receive one of the projections.

7. An assembly in accordance with claim 6, wherein the terminal connector comprises a base and two outwardly extending arms, and wherein one of the recesses is formed by each of the arms.

* * * * *